US007410075B2

(12) United States Patent
Killoren et al.

(10) Patent No.: US 7,410,075 B2
(45) Date of Patent: Aug. 12, 2008

(54) METHOD AND APPARATUS FOR INSULATING FLUIDS CONTAINED WITHIN A CONTAINER

(76) Inventors: John Francis Killoren, 69 Hawthorn Estates, St. Louis, MO (US) 63131; Mark Kevin Killoren, 729 Lillian, Collinsville, IL (US) 63324

( * ) Notice: Subject to any disclaimer, the term of this patent is extended or adjusted under 35 U.S.C. 154(b) by 568 days.

(21) Appl. No.: 10/818,382

(22) Filed: Apr. 5, 2004

(65) Prior Publication Data

US 2005/0224504 A1 Oct. 13, 2005

(51) Int. Cl.
*B65D 25/00* (2006.01)

(52) U.S. Cl. ..... 220/739

(58) Field of Classification Search ..... 220/137, 220/738, 739, 737

See application file for complete search history.

(56) References Cited

U.S. PATENT DOCUMENTS 973,085 A * 10/1910 Strause ..... 220/737
2,727,645 A * 12/1955 Dore ..... 215/393
3,941,237 A * 3/1976 MacGregor, Jr. ..... 198/867.13
4,534,391 A * 8/1985 Ventimiglia et al. ..... 220/739
4,747,507 A * 5/1988 Fitzgerald et al. ..... 220/739
5,253,780 A * 10/1993 Adado ..... 220/711
5,467,891 A 11/1995 Perry
6,305,656 B1 * 10/2001 Wemyss ..... 248/309.4
6,367,652 B1 4/2002 Toida et al.

* cited by examiner

*Primary Examiner*—Anthony D Stashick
*Assistant Examiner*—Harry A Grosso
(74) *Attorney, Agent, or Firm*—Armstrong Teasdale LLP

(57) ABSTRACT

A receptacle for insulating a container. The receptacle includes a bottom and a sidewall circumscribing the bottom and extending from the bottom to an upper edge. The bottom and the sidewall define a cavity for the receptacle, and the cavity is sized to at least partially receive the container therein such that a gap remains defined between the container and an inner surface of the receptacle. The receptacle facilitates insulating the container.

14 Claims, 2 Drawing Sheets

METHOD AND APPARATUS FOR INSULATING FLUIDS CONTAINED WITHIN A CONTAINER

BACKGROUND OF THE INVENTION

This invention relates generally to insulating containers and, more particularly, to methods and systems for insulating fluids within a container.

Disposable paper or plastic beverage cups having a generally smooth cylindrical or tapered sidewall are commonly used by recreational vendors, coffee shops, fast food restaurants, convenience stores and the like. Although convenient because such cups are easily stacked, such cups generally do not maintain a temperature of the fluid contained in the cup. Specifically, the paper or plastic material used to make these cups often times does not sufficiently insulate the cup.

At least some known insulated receptacles receive cylindrical containers therein to facilitate insulating the portion of the container contained within the insulated receptacle. More specifically, such receptacles are generally sized to circumscribe the container, such that the insulating material tightly contacts the external and bottom surfaces of the cylindrical container. Accordingly, the size and shape of a container that may be effectively received within such insulated receptacles may be limited. Moreover, because of the tight fit created between the insulated receptacle and the container, it may be difficult to remove or install the container into or from the insulating receptacle.

Other known insulated receptacles are used with containers having tapered sidewalls. However, such insulated receptacles generally extend around only a portion of the container such that a portion of the container, including the bottom surface of the container, remains un-insulated. Such receptacles are commonly used with disposable paper coffee cups to facilitate shielding a user's hand from heat transferred through the cup by the hot fluid contained therein.

BRIEF DESCRIPTION OF THE INVENTION

In one aspect, a receptacle is provided for insulating a container. The receptacle includes a bottom, and a sidewall circumscribing the bottom and extending from the bottom to an upper edge. The bottom and the sidewall define a cavity for the receptacle, and the cavity is sized to at least partially receive the container therein such that a gap remains defined between the container and an inner surface of the receptacle. The receptacle facilitates insulating the container.

In another aspect, a method is provided for insulating a container. The method includes providing an insulating receptacle having a bottom and a sidewall that circumscribes the bottom and extends from the bottom to an upper edge, wherein the sidewall includes a plurality of ridges. The bottom and sidewall define a cavity within the insulating receptacle. The method further includes inserting the container at least partially into the insulating receptacle cavity such that a gap is defined at least partially between the container and an inner surface of the insulating receptacle. The insulating receptacle facilitates maintaining a temperature of a substance contained within the container.

In yet another aspect, an insulating receptacle is provided for insulating a container. The insulating receptacle includes a bottom comprising an inner surface and an outer surface, and a sidewall circumscribing the bottom and extending from the bottom to an upper edge. The upper edge has a diameter that is wider than a diameter of the bottom. The sidewall has an inner surface, an outer surface, and a plurality of ridges extending radially inward from the sidewall inner surface. The plurality of ridges extend at least partially between the upper edge and the bottom for maintaining a gap at least partially between the sidewall and the container.

DETAILED DESCRIPTION OF THE INVENTION

Figure 1:
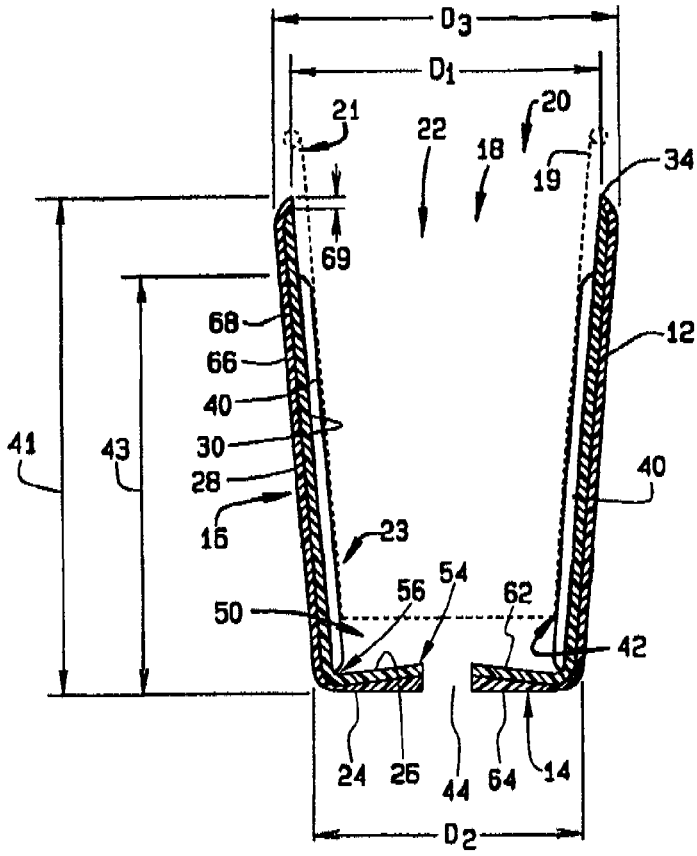
FIG. 1 is a side cross-sectional view of an exemplary insulating receptacle.
Figure 2:
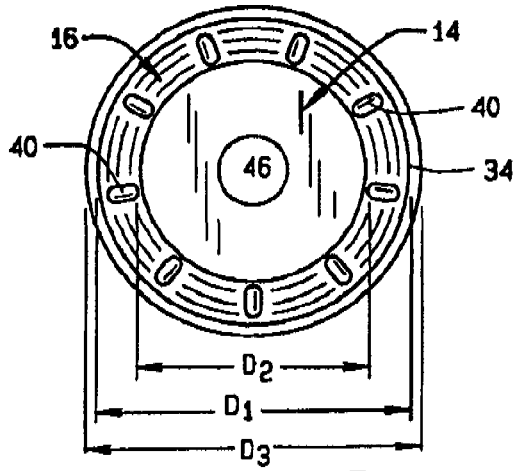
FIG. 2 is a top view of the insulating receptacle shown in FIG. 1.

FIG. 1 is a side cross-sectional view of an exemplary insulating receptacle 10. FIG. 2 is a top view of insulating receptacle 10. Receptacle 10 includes an insulating body 12 having a bottom 14, and a sidewall 16 that extends from and circumscribes bottom 14. Insulating receptacle 10 has an open end 18 that enables a container 20 to be at least partially inserted within a cavity 22 defined by insulating receptacle bottom 14 and sidewall 16. In the exemplary embodiment, insulating receptacle 10 at least partially insulates a container 20 having tapered sidewalls 19 such that an upper portion 21 of container 20 has a larger diameter than a bottom portion 23 of container 20. In the exemplary embodiment, container contains either a hot substance or a cold substance therein, and insulating receptacle facilitates maintaining the temperature of the substance contained within container 20.

Bottom 14 includes an outer surface 24 and an inner surface 26. Bottom outer surface 24 is substantially planar to enable receptacle 10 to be set upright atop a generally planar supporting surface (not shown). Sidewall 16 includes an outer surface 28 and an inner surface 30. Sidewall 16 circumscribes bottom 14 and extends radially outward therefrom to an upper edge 34 that defines open end 18. In the exemplary embodiment, bottom 14 and sidewall 16 are unitarily formed together.

In the exemplary embodiment, sidewall 16 has a cone shape, such that sidewall 16 tapers inwardly from upper edge 34 to bottom 14. Accordingly, upper edge 34 has a diameter $D_1$ that is generally greater than a diameter $D_2$ of bottom 16. The cone shape of sidewall 16 facilitates providing a greater insulating value to containers 20 inserted into cavity 22 that include tapered sidewalls 19. In one embodiment, diameters $D_1$ and $D_2$ have a length ranging from approximately 2.0 to 4.0 inches. In another embodiment, $D_1$ has a length of approximately 3.40 inches and $D_2$ has a length of approximately 2.75 inches. Diameters $D_1$ and $D_2$ are selected to facilitate balancing between weight, material strength, and material cost.

Sidewall upper edge 34 is tapered to facilitate a sealing contact being formed between receptacle 10 and container 20. The sealing contact facilitates preventing entry of spillage of the substance contained within container 20 from entering cavity 22. More specifically, spillage entering cavity 22 between receptacle sidewall 16 and container sidewall 19 may make it more difficult to remove container 20 from insulating receptacle 10. Accordingly, upper edge 34 has diameter $D_1$ that is smaller than a diameter $D_3$ of at least a portion of sidewall 16 measured between upper edge 34 and bottom 14. More specifically, sidewall 16 extends outwardly from upper edge 34 before tapering inwardly towards bottom 14. In one embodiment, diameters $D_1$ and $D_3$ have a length ranging from approximately 2.0 to 4.0 inches. In another embodiment, $D_1$ has a length of approximately 3.40 inches and $D_3$ has a length of approximately 2.75 inches. Diameters $D_1$ and $D_3$ are selected to facilitate balancing between weight, material strength, and material cost.

Sidewall 16 has a length 41 and includes a plurality of ridges 40 that extend radially inward for a length 43 from sidewall inner surface 30 into cavity 22. In the exemplary embodiment, ridges 40 extend longitudinally at least partially between upper edge 34 and bottom 16 to ensure at least one air gap 42 remains defined between at least a portion of sidewall inner surface 30 and container 20. In one embodiment, sidewall length 41 ranges from approximately 4.0 to 6.0 inches. In another embodiment, sidewall length 41 is approximately 5.125 inches. In one embodiment, ridge length 43 ranges from approximately 3.0 to 5.0 inches. In another embodiment, ridge length is approximately 4.0 inches. Sidewall and ridge lengths, 41 and 43 are selected to facilitate balancing between weight, material strength, and material cost. Each air gap 42 facilitates insertion and removal of container 20 with respect to insulating receptacle 10, and also enables condensation to be channeled away from container 20 through gap 42. In an alternative embodiment, ridges 40 are oriented across inner surface 30, such as, but not limited to, a helical, spiral, circular, coiled, or screw shaped pattern. In another alternative embodiment, ridges 40 have a non-uniform thickness. In yet another alternative embodiment, ridges 40 are flexible such that ridges 40 are capable of folding over or flexing as container 20 is inserted into receptacle 10, and as such, ridges 40 are capable of frictionally engaging containers 20 of varying sizes, while still maintaining at least one air gap 42.

In the exemplary embodiment, bottom 14 includes an opening 44 extending between bottom outer surface 24 and inner surface 26. Opening 44 facilitates venting insulating receptacle 10 when container 20 is inserted and removed therefrom. In an alternative embodiment, in lieu of or in addition to opening 44, sidewall 16 includes an opening 80 extending between sidewall outer surface 28 and inner surface 30. Opening 44 facilitates venting insulating receptacle 10 when container 20 is inserted and removed therefrom, Opening 44 also facilitates draining any condensation formed within receptacle 10 which has been channeled to bottom 16.

In the exemplary embodiment, receptacle bottom and sidewall 14 and 16, respectively, define a cross-sectional area that is sized to receive container 20 at least partially therein such that a gap 50 remains defined between bottom inner surface 26 and container bottom 52. In the exemplary embodiment, gap 50 is in flow communication with each air gap 42, and gap 50 is defined because bottom inner surface 26 is non planar. Specifically, in the exemplary embodiment, a center portion 54 of bottom 14 is elevated with respect to an outer portion 56 of bottom 14.

Gap 50 creates a dead air space between bottom inner surface 26 and container bottom 52 which facilitates insertion and removal of container 20 with respect to insulating receptacle 10. Gap 50 also provides a space for collecting condensation that is formed on container 20 prior to the condensation being channeled from receptacle 10 through opening 44. In an alternative embodiment, gap 50 is defined because a diameter of container 20 enables container 20 to be only partially inserted into receptacle 10 such that container bottom portion 23 remains a distance from bottom inner surface 26. Specifically, in such an embodiment, a sidewall of such a container contacts receptacle sidewall 16 such that further insertion of container 20 within receptacle 10 is limited. In another embodiment, a container lip 58 extending outwardly from container 20 limits a depth of insertion of container 20 within receptacle 10. In another alternative embodiment, gap 50 is defined because bottom 16 has a frusto-conical shape such that center and outer portions 54 and 56, respectively, of bottom 16 have different thicknesses wherein bottom inner surface 26 is tapered from center portion 54 to outer portion 56.

In the exemplary embodiment, body 12 has an insulating layer 62 and a coating layer 64. Insulating layer 62 includes a bottom insulating layer 66 and a sidewall insulating layer 68. Layers 66 and 68 are fabricated from an insulating material such as, for example, a rubberized material. However, other insulating materials can be utilized, provided the insulating material facilitates providing appropriate thermal resistance against heat gain or loss between the substance in container 20 and the ambient environment, as is described herein in more detail. In the exemplary embodiment, insulating layers 66 and 68 are integrally formed with one another in a single mold using a dipping process. In an alternative embodiment, bottom insulating layer 66 is coupled to sidewall insulating layer 68 using, for example, a glue seaming process. Alternatively, insulating layers 66 and 68 are coupled together using a known process or fastening means, such as, but not limited to, a chemical bonding process or bonding agents. In an alternative embodiment, receptacle 10 includes more than one insulating layer formed into a single mold by dipping the mold numerous times.

Coating layer 64 surrounds insulating layer 66 and is fabricated from a flexible material, and in the exemplary embodiment, is a vinyl coating, or a coating fabricated from a similar material. Accordingly, coating layer 64 facilitates holding the insulating receptacle 10 or resting the insulating receptacle 10 on a supporting surface (not shown). Coating layer 64 is sufficiently rigid and stable to maintain its form, however is sufficiently flexible to be squeezed or gripped around container 20. In the exemplary embodiment, coating layer 64 extends beyond insulating layer 62 a distance 69 to facilitate manufacturing of insulating receptacle 10 and to facilitate sealing container 20 within insulating receptacle 10. In an alternative embodiment, receptacle 10 includes more than one coating layer formed into a single mold by dipping the mold numerous times. In one embodiment, body 12 has a thickness ranging from approximately 0.050 to 0.20 inches. In another embodiment, body thickness is approximately 0.10 inches. Body thickness facilitates balancing between weight, material strength, and material cost.

Figure 3:
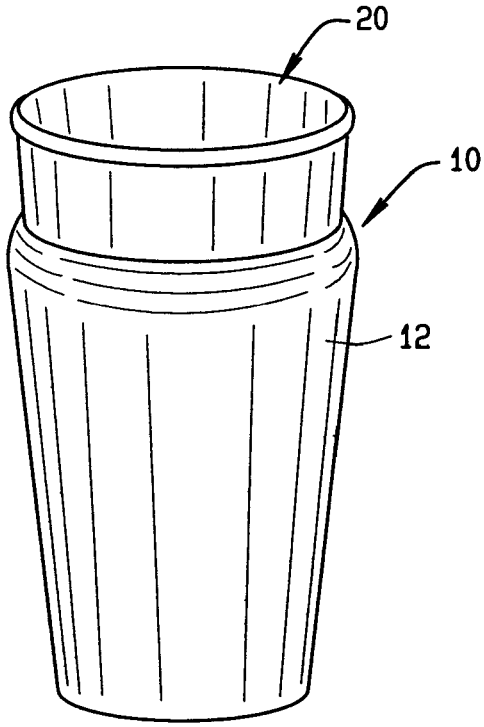
FIG. 3 is perspective view of the insulating receptacle shown in FIG. 1 including a container contained therein.
Figure 4:
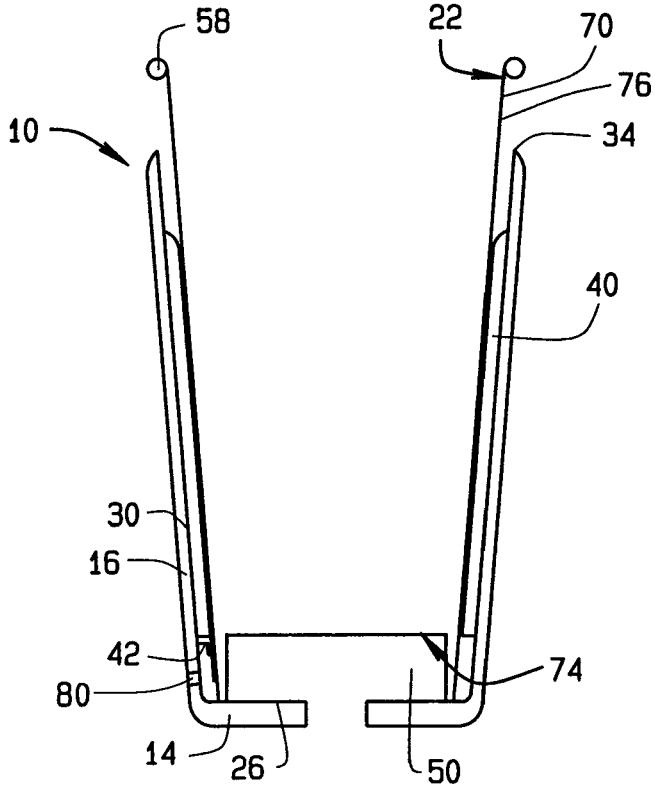
FIG. 4 is a cross-sectional view of the insulating receptacle shown in FIG. 3 and taken along line 4-4.

FIG. 3 is a perspective view of container 20 inserted within insulating receptacle 10. FIG. 4 is a cross-sectional view of insulating receptacle 10 and container 20 taken along line 4-4. Insulating receptacle body 12 is variably sized to receive containers 20 having different sizes and shapes. In the exemplary embodiment, body 12 is sized to receive a container 20, such as, but not limited to, a vendor cup 70 having a top 72, a bottom 74, and an outer perimeter 76 extending therebetween. Specifically, in the exemplary embodiment, body 12 is sized to receive eighteen, twenty, and twenty-four ounce vendor cups. Vendor cup 70 is of the type that is generally served at a convenient store, or a recreational sports park. Top 72 extends at least partially beyond sidewall upper edge 34, and in one embodiment, top 72 includes a lip 58 that extends outward from vendor cup top 72. In an alternative embodiment, lip 58 extends over and rests upon insulating receptacle upper edge 34 when container 70 is inserted into receptacle cavity 22.

In the exemplary embodiment, vendor cup bottom 74 contacts at least a portion of receptacle bottom inner surface 26, such that gap 50 provides dead air space between inner surface 26 and bottom 74. In one embodiment, vendor cup bottom 74 remains a distance above bottom inner surface 26 such that a gap 50 is defined between bottom 74 and inner surface 26. Gap 50 is formed by vendor cup outer perimeter 76 extending beyond vendor cup bottom 74. As such, outer perimeter 76 is in supporting contact with bottom inner surface 26 and vendor cup bottom 74 is elevated the distance to form gap 50. Gap 50 facilitates providing additional dead air space between bottom inner surface 26 and vendor cup bottom 74 for ease of insertion and removal of vendor cup 70 with respect to insulating receptacle 10, and for collecting condensation. In the exemplary embodiment, ridges 40 extend longitudinally at least partially between upper edge 34 and bottom 16, to ensure an air gap 42 remains defined between sidewall inner surface 30 and container outer perimeter 76. Air gap 42 facilitates insertion and removal of container 20 with respect to insulating receptacle 10, and also provides an area for condensation to form and be channeled away from container 20.

In an alternative embodiment, insulating receptacle body 12 is sized to receive a container 20 having different dimensions than vendor cup 70, such as, but not limited to, an ice cream container (not shown) having top 72, bottom 74, and outer perimeter 76 with substantially different dimensions as vendor cup 70. Ice cream container is of the type that is generally served at a grocery store, a convenient store, or a recreational sports park. In one embodiment, bottom 74 has a planar bottom surface which contacts at least a portion of bottom inner surface 26. Gap 50 is defined at least partially between bottom inner surface 26 and the planar bottom surface of container 20. Gap 50 facilitates providing a dead air space between bottom inner surface 26 and planar bottom surface for ease of insertion and removal of container 20 with respect to insulating receptacle 10.

The above-described insulating receptacles provide a cost effective and reliable means for insulating and supporting containers, particularly vending or vendor style cups. The insulating receptacles are fabricated from an insulated material that facilitates insulating the substance contained within the container. The insulating receptacles include dead air spaces defined within the cavity, which facilitate containers being removed and installed within the insulating receptacle. Accordingly, friction generated between the insulating receptacle and the container is reduced. As a result, the insulating receptacle facilitates maintaining the temperature of the substance contained within the container in a cost effective and reliable manner.

Exemplary embodiments of insulating receptacles are described above in detail. The receptacles are not limited to the specific embodiments described herein, but rather, components of each system may be utilized independently and separately from other components described herein. For example, each insulating receptacle component can also be used in combination with other container insulating receptacle components.

While the invention has been described in terms of various specific embodiments, those skilled in the art will recognize that the invention can be practiced with modification within the spirit and scope of the claims.

What is claimed is:

1. A receptacle for insulating a container, said receptacle comprising:

a bottom having at least one opening extending therethrough for venting said receptacle; and a sidewall circumscribing said bottom and extending from said bottom to an upper edge, said sidewall is tapered from said bottom to said upper edge such that said upper edge has a diameter that is wider than a diameter of said bottom, said bottom and said sidewall defining a cavity for said receptacle, said cavity is sized to at least partially receive the container therein such that a gap remains defined between the container and an inner surface of said receptacle, said inner surface of said bottom defined by a center portion and an outer portion, said outer portion extends substantially circumferentially from said sidewall, said center portion extends substantially circumferentially about said opening, said center portion is elevated with respect to said outer portion such that said inner surface of said bottom is tapered from said center portion to said outer portion, and such that said gap is non-uniform, said receptacle facilitates insulating the container.

2. A receptacle in accordance with claim 1 wherein said bottom is formed unitarily with said sidewall.

3. A receptacle in accordance with claim 1 wherein said sidewall comprises at least one opening extending therethrough for venting said receptacle when the container is inserted into and removed from said cavity.

4. A receptacle in accordance with claim 1 wherein a plurality of ridges extends radially inwardly and longitudinally at least partially between said upper edge and said bottom, said plurality of ridges ensure said gap extends at least partially between said sidewall and said container.

5. A receptacle in accordance with claim 1 wherein said upper edge has a diameter that is smaller than a diameter of at least a portion of said sidewall.

6. A receptacle in accordance with claim 1 wherein said sidewall comprises a plurality of layers.

7. A method for insulating a container, said method comprising:

providing an insulating receptacle having a bottom and a sidewall that circumscribes the bottom and extends from the bottom to an upper edge, wherein the bottom includes at least one opening extending therethrough for venting the receptacle, and wherein the sidewall includes a plurality of ridges, the sidewall is tapered from the bottom to the upper edge such that the upper edge has a diameter that is wider than a diameter of the bottom, wherein the bottom and sidewall define a cavity within the insulating receptacle; and inserting the container at least partially into the insulating receptacle cavity such that a gap is defined at least partially between the container and an inner surface of the insulating receptacle, wherein the inner surface of the bottom is defined by a center portion and an outer portion, the outer portion extending substantially circumferentially from the sidewall, the center portion extending substantially circumferentially about the opening and being elevated with respect to the outer portion such that the inner surface of the bottom is tapered from the center portion to the outer portion, and such that the gap is non-uniform, the insulating receptacle facilitates maintaining a temperature of a substance contained within the container.

8. A method in accordance with claim 7 wherein providing an insulating receptacle further comprises providing an insulating receptacle including a bottom that is formed unitarily with the sidewall.

9. A method in accordance with claim 7 wherein providing an insulating receptacle further comprises providing an insulating receptacle that is sized to ensure a gap is at least partially defined between the sidewall and the container when the container is inserted at least partially within the insulating receptacle.

10. A method in accordance with claim 7 wherein providing an insulating receptacle further comprises providing a plurality of ridges extending radially inward from the sidewall and at least partially longitudinally between the insulating receptacle upper edge and bottom.

11. A method in accordance with claim 7 wherein providing an insulating receptacle further comprises tapering the upper edge wherein the upper edge has a diameter that is smaller than a diameter of at least a portion of the sidewall.

12. An insulating receptacle for insulating a container, said insulating receptacle comprising:

a bottom comprising an inner surface and an outer surface and at least one opening extending therethrough for venting said receptacle; and a sidewall circumscribing said bottom and extending from said bottom to an upper edge, said upper edge has a diameter that is wider than a diameter of said bottom, said sidewall comprising an inner surface, an outer surface, and a plurality of ridges extending radially inward from said sidewall inner surface, said plurality of ridges extend at least partially between said upper edge and said bottom for maintaining a gap at least partially between said sidewall and said container, said inner surface of said bottom defined by a center portion and an outer portion, said outer portion extends substantially circumferentially from said sidewall, said center portion extends substantially circumferentially about said opening, said center portion is elevated with respect to said outer portion such that said inner surface of said bottom is tapered from said center portion to said outer portion, and such that said gap is non-uniform.

13. An insulating receptacle in accordance with claim 12 wherein said bottom is formed unitarily with said sidewall.

14. An insulating receptacle in accordance with claim 12 wherein said upper edge has a diameter that is smaller than a diameter of at least a portion of said sidewall.

* * * * *